US005857412A

United States Patent [19]

Roskosch et al.

[11] Patent Number: 5,857,412

[45] Date of Patent: Jan. 12, 1999

[54] INK DOSING DEVICE FOR A PRINTING PRESS

[75] Inventors: Bernhard Roskosch, Wiesloch; Michael Voge, Malsch, both of Germany

[73] Assignee: Heidelberger Druckmaschinen AG, Heidelberg, Germany

[21] Appl. No.: 916,565

[22] Filed: Aug. 22, 1997

[30] Foreign Application Priority Data

Aug. 22, 1996 [DE] Germany ..... 296 14 580.7

[51] Int. Cl.[6] ..... B41F 31/05; B41F 31/06

[52] U.S. Cl. ..... 101/365

[58] Field of Search ..... 101/365, 157, 101/169, 350.1, 350.2, 350.6, 148; 118/261; 15/256.51

[56] References Cited

U.S. PATENT DOCUMENTS 2,161,943 6/1939 Baue .
3,922,966 12/1975 Despot ..... 101/365
4,554,870 11/1985 Fischer ..... 101/365

FOREIGN PATENT DOCUMENTS 0331781 9/1989 European Pat. Off. .
3323049 3/1984 Germany .

*Primary Examiner*—J. Reed Fisher
*Attorney, Agent, or Firm*—Nils H. Ljungman and Associates

[57] ABSTRACT

An ink dosing device in the inking unit of rotary or offset printing press is disclosed with an inking roller which corresponds to an ink fountain. The ink dosing device also has dosing elements which are divided into zones. The dosing elements can be adjusted individually with respect to the cylindrical surface of the inking roller. The dosing elements are realized as tongue-shaped and are fastened to a base body. Each dosing element is adjustably fastened to the base body by elastic intermediate shims.

20 Claims, 2 Drawing Sheets

INK DOSING DEVICE FOR A PRINTING PRESS

BACKGROUND OF THE INVENTION

1. Field of the Invention

The present invention relates generally to an ink dosing device in the inking unit of rotary or offset printing presses. The ink dosing device can have an inking roller. The inking roller corresponds to or is part of an ink fountain. The ink dosing device also has dosing elements divided into zones. The dosing elements can be adjusted individually with respect to the cylindrical surface of the inking roller. The dosing elements have a tongue-shaped configuration and are fastened to a base body.

2. Background Information

An ink dosing device as described above is disclosed in U.S. Pat. No. 2,161,943. The individual dosing elements can be adjusted so that they can be set at a specified distance, e.g. by means of set screws, with respect to the cylindrical surface of the inking roller. If no ink is required in one zone, the tongue-shaped dosing element is moved until it comes in contact with the cylindrical surface of the inking roller, so that no ink can pass through. Depending on how much ink is required in the respective zone, the gap between the dosing element and the cylindrical surface of the inking roller can be increased, so that the corresponding amount of ink can be supplied to the printing plate by means of the inking unit and be used to ink the printing plate. Because the accuracy or precision of the adjustment means has been improved significantly on modern printing presses and changes can be made in the range of micrometers, to set the ink gap accurately, it is necessary to adjust the individual tongues very precisely, a function which was not necessary in similar known devices. In the other known devices, the tongues are bolted to the base body, and there is no other way to orient them.

OBJECT OF THE INVENTION

The object of the present invention is to make it possible to orient the individual tongue-shaped dosing elements very accurately or with a high degree of precision with respect to one another and with respect to the cylindrical surface of the inking roller, so that manufacturing tolerances, for example, will not result in differences in settings.

SUMMARY OF THE INVENTION

The present invention teaches that this object is achieved in accordance with one possible embodiment by adjustably fastening each dosing element to the base body by means of elastic intermediate shims, spacers, liners or fillers. The elastic intermediate shims make it possible to adjust the inclination and the height of each tongue individually with respect to the cylindrical surface of the inking roller, so that a uniform starting, zero or reference position is achieved. From this starting position, the required ink gap can then be set with great accuracy by means of the corresponding actuator elements, so that any differences which may exist between the individual dosing elements do not have any negative influence on the setting.

In one advantageous embodiment of the present invention, the elastic intermediate shims correspond to the fastening means, so that an individual adjustment can be made by each fastening means.

An additional advantageous embodiment of the present invention shows that screws are used as the fastening means for each dosing element. The screws can correspond to elastic washers or discs, which elastic washers function as intermediate shims. In this embodiment, it is advantageous that each dosing element is fastened by means of three screws with intermediate shims. As a result of this three-point mounting, the height and also the inclination can be adjusted with a high degree of precision with respect to the cylindrical surface of the inking roller, to achieve near absolute parallelism with respect to the cylindrical surface of the inking roller.

In other words, the three-point mounting can allow both the height and the inclination of each dosing element to be adjusted with a high degree of precision. The mounting of the dosing elements with a high degree of precision can be used to achieve substantial alignment of the dosing elements with respect to the cylindrical surface of the inking roller.

In an additional advantageous embodiment of the present invention, the elastic washers are realized in the form of conical spring washers, strain washers or Belleville spring washers. Rubber or plastic washers with an appropriate hardness can also be used for the adjustment of the tongue-shaped dosing elements, as long as the washers in question have the required elasticity.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below, with reference to the embodiments illustrated in the accompanying drawings, wherein.

DESCRIPTION OF THE PREFERRED EMBODIMENT

Figure 1:
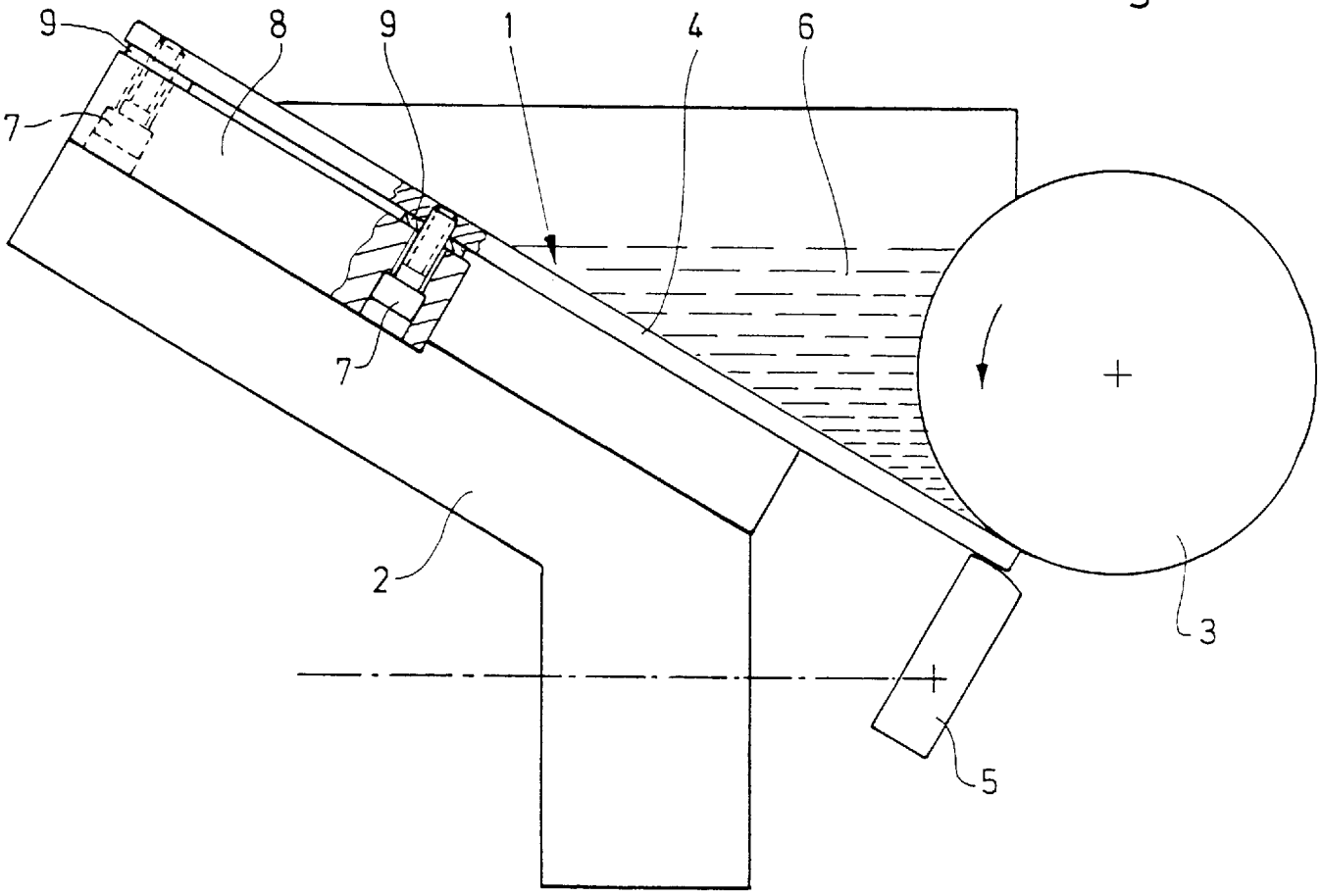
FIG. 1 is a plan view of the ink dosing device from the end surface.

The ink dosing element or device 1 can be provided on an ink fountain 2. Corresponding to the ink fountain 2 there is preferably an inking roller 3. In the illustrated example of FIG. 1, there can be tongue-shaped or elongated dosing elements 4 assigned to individual zones and located in close proximity next to one another. The forward area of these tongue-shaped dosing elements 4 can be adjusted by means of actuators 5 with respect to the cylindrical surface of the inking roller 3.

In another possible embodiment of the present invention, the actuators 5 are preferably used to displace the ends of the dosing elements 4 near the inking roller 3. By displacing the ends of the dosing elements 4 near the inking roller 3, the actuators 5 can regulate the size of the gap between the ends of the dosing elements 4 and the inking roller 3.

Between the dosing elements 4 and the inking roller 3 there may be an ink reservoir 6, from which an ink film is formed as a function of the distance between the cylindrical surface of the inking roller 3 and the dosing element 4. The ink film can then be fed to the inking mechanism.

In the illustrated embodiment of FIG. 1, the dosing elements 4 can be fastened by means of screws 7 to a base body 8. The base body 8 in turn can be fastened to the ink fountain 2 and which, if necessary, can be removed with the dosing elements 4 as a unit.

In another possible embodiment of the present invention, either the base body 8 and the dosing elements 4 can be removed as a single unit or the base body 8, ink fountain 2 and the dosing elements 4 can be removed a single unit.

Each dosing element 4 can be adjustably fastened by means of three screws 7 to the base body 8. Between the dosing element 4 and the base body 8, there is preferably an elastic intermediate shim 9. The intermediate shim 9 may be advantageously realized in the form of a ring, and this ring is advantageously provided in the vicinity of the screws 7, so that the height and inclination of the dosing element 4 can be adjusted by means of the torque applied respectively to each screw 7. The three screws 7 thereby create a three-point mounting of each dosing element 4, which makes it possible to adjust each dosing element 4 with accuracy and precision. The elastic intermediate shims 9 can be advantageously realized in the form of conical spring washers or Belleville spring washers, so that a precision adjustment can be possible.

Figure 2:
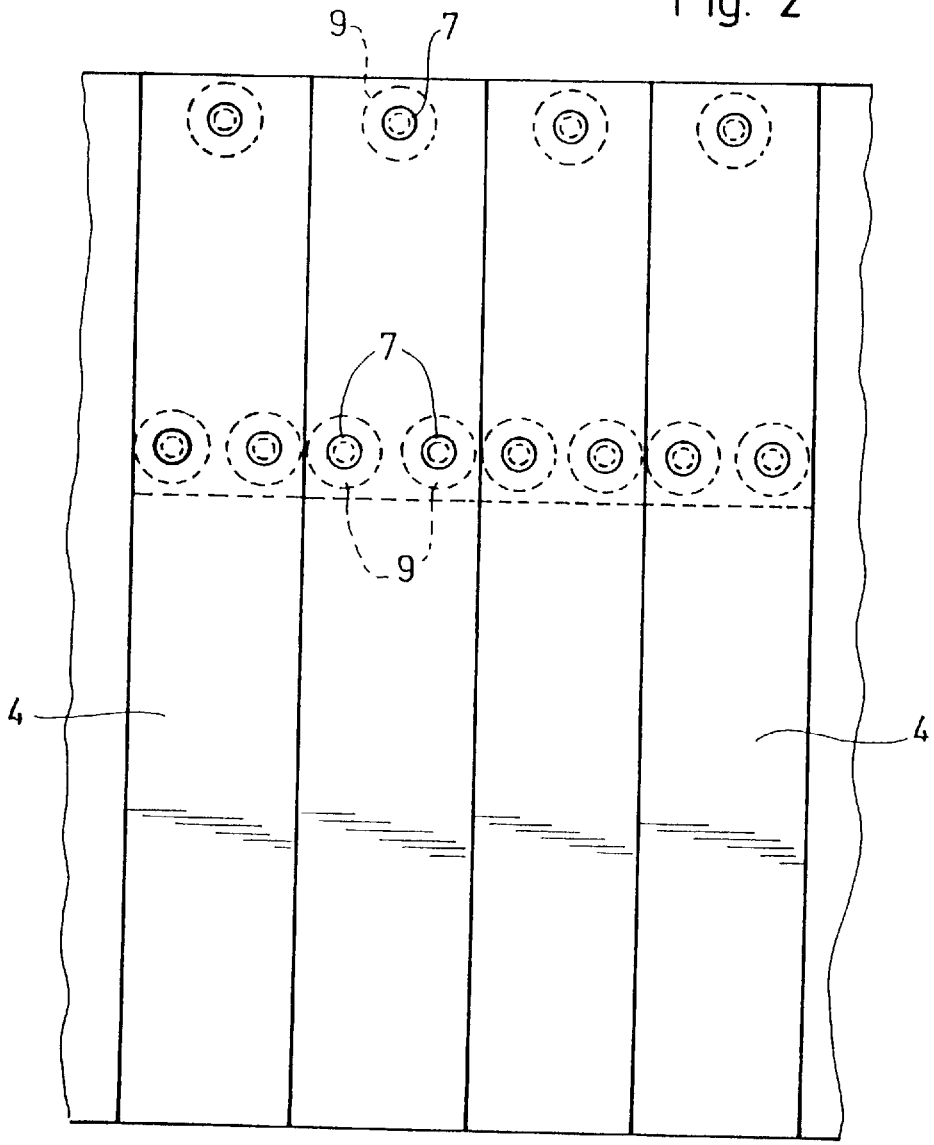
FIG. 2 is an overhead view of the tongue-shaped dosing elements.

FIG. 2 illustrates the arrangement of the screws 7 with intermediate shims 9.

In accordance with one possible embodiment of the present invention the dosing elements 4 are preferably shown as a series of strips placed side by side next to each other. The end of the dosing element 4 opposite the inking roller 3 can have a screw 7 and an intermediate shim 9 fastened in the center of the dosing element 4 to adjust the height of the dosing element 4. The dosing element 4 can also have a pair of screws 7 and intermediate shims 9 next to each other across the dosing element 4 to adjust the inclination of the dosing element 4 on either side.

Figure 3:
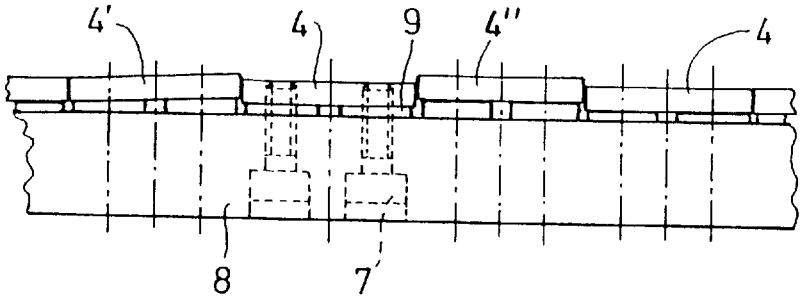
FIG. 3 is a head-on view of the dosing elements.

FIG. 3 shows a sample setting of the tongue-shaped dosing elements 4, whereby the inclination of the left-hand dosing element 4' should be corrected, and the height of the next-but-one dosing element 4" should be adjusted. These adjustments can be made easily if the ink dosing device 1 is calibrated or adjusted outside the ink fountain 2.

In accordance with one possible embodiment of the present invention, the height of the dosing element 4" next to the dosing element 4 shown on the right in FIG. 2 should be adjusted to match the other dosing elements 4.

One feature of the invention resides broadly in the ink dosing device in the inking unit of rotary or offset printing presses with an inking roller which corresponds to an ink fountain, with dosing elements which are divided into zones, which dosing elements can be adjusted individually with respect to the cylindrical surface of the inking roller, whereby the dosing elements are realized so that they are tongue-shaped and are fastened to a base body, characterized by the fact that each dosing element 4 is adjustably fastened to the base body 8 by means of elastic intermediate shims 9.

Another feature of the invention resides broadly in the ink dosing device characterized by the fact that there are elastic intermediate shims 9 corresponding to the fastening means.

Yet another feature of the invention resides broadly in the ink dosing device characterized by the fact that as fastening means for each dosing element 4, there are screws 7, corresponding to which there are elastic washers which act as intermediate shims 9.

Still another feature of the invention resides broadly in the ink dosing device characterized by the fact that each dosing element 4 is fastened by means of three screws 7 with intermediate shims 9.

A further feature of the invention resides broadly in the ink dosing device characterized by the fact that the elastic intermediate shims 9 are realized in the form of conical spring washers or Belleville spring washers.

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein are hereby incorporated by reference as if set forth in their entirety herein.

The corresponding foreign patent publication applications, namely, Federal Republic of Germany Patent Application No. DE 296 14 580.7, filed on Aug. 22, 1996, having inventors Bernhard Roskosch and Dr. Michael Voge, and DE-OS 296 14 580.7 and DE-PS 296 14 580.7, are hereby incorporated by reference or if set forth in their entirety hereto.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An ink dosing device for inking units of printing presses, said ink dosing device comprising:

an inking roller;

said inking roller comprising an outer surface;

said outer surface of said inking roller being arranged into a plurality of ink dosing zones;

a plurality of dosing elements;

each of said plurality of dosing elements being disposed adjacent to a corresponding one of said plurality of ink dosing zones;

a base body;

said base body being configured and disposed to mount said plurality of dosing elements thereon;

a plurality of shims;

each of said plurality of shims comprising an elastic material; and each of said plurality of shims being configured and disposed to adjustably connect one of said plurality of dosing elements to said base body.

2. The ink dosing device according to claim 1, wherein each of said plurality of dosing elements has a substantially elongated shape.

3. The ink dosing device according to claim 2, further comprising:

a plurality of fastening members;

each of said plurality of fastening members being configured and disposed to connect one of said plurality of dosing elements to said base body; and each of said plurality of shims being disposed adjacent to a corresponding one of said plurality of fastening members.

4. The ink dosing device according to claim 3, wherein said plurality of fastening members comprises a plurality of screws.

5. The ink dosing device according to claim 4, wherein:

said plurality of shims comprises a plurality of elastic washers; and each of said plurality of elastic washers is disposed adjacent to said corresponding one of said plurality of screws.

6. The ink dosing device according to claim 5, wherein:

said plurality of dosing elements and said outer surface of said inking roller are configured and disposed to together form a gap therebetween;

each of said plurality of dosing elements is configured and disposed to be moved to adjust the size of said gap formed between said plurality of dosing elements and said inking roller; and said gap formed between said plurality of dosing elements and said inking roller is configured to regulate the size of an ink film passing through said gap to a corresponding one of said plurality of ink dosing zones.

7. The ink dosing device according to claim 6, wherein each of said plurality of dosing elements is connected to said base body by three screws of said plurality of screws and three elastic washers of said plurality of elastic washers.

8. The ink dosing device according to claim 7, wherein said three screws and said three elastic washers corresponding to one of said plurality of dosing elements are configured and disposed to permit alignment of said corresponding dosing element with the others of said plurality of dosing elements.

9. The ink dosing device according to claim 8, wherein said three screws and said three elastic washers corresponding to one of said plurality of dosing elements being configured and disposed to permit an adjustment of the distance between said base body and said corresponding dosing element and an adjustment of the inclination of said corresponding dosing element with respect to said base body.

10. The ink dosing device according to claim 9, wherein said plurality of elastic washers comprises one of:

conical spring washers; and

Belleville spring washers.

11. The ink dosing device according to claim 10, wherein:

said plurality of dosing elements and said inking roller are configured and disposed to together permit the formation of an ink reservoir; and said ink reservoir is configured to contain ink used by said ink dosing device to form an ink film.

12. The ink dosing device according to claim 11, wherein:

each of said plurality of dosing elements are substantially tongue-shaped;

each of said plurality of dosing elements comprises a first end and a second end disposed opposite to said first end;

said first end of each of said plurality of dosing elements is disposed adjacent to said outer surface of said inking roller;

said plurality of screws and said plurality of elastic washers are disposed adjacent to said second end of each of said plurality of dosing elements;

said ink dosing device comprises an actuator arrangement; and said actuator arrangement being configured and disposed to adjust the distance between said first end of each of said plurality of dosing elements and said outer surface of said inking roller to adjust the size of said gap.

13. An ink dosing device for inking units of printing presses, said ink dosing device comprising:

a plurality of dosing elements;

each of said plurality of dosing elements to be disposed adjacent to a corresponding ink dosing zone of an inking roller;

a base body;

said base body being configured and disposed to mount said plurality of dosing elements thereon;

a plurality of shims;

each of said plurality of shims comprising an elastic material; and each of said plurality of shims being configured and disposed to adjustably connect one of said plurality of dosing elements to said base body.

14. The ink dosing device according to claim 13, wherein each of said plurality of dosing elements has a substantially elongated shape.

15. The ink dosing device according to claim 14, further comprising:

a plurality of fastening members;

each of said plurality of fastening members being configured and disposed to connect one of said plurality of dosing elements to said base body; and each of said plurality of shims being disposed adjacent to a corresponding one of said plurality of fastening members.

16. The ink dosing device according to claim 15, wherein said plurality of fastening members comprises a plurality of screws.

17. The ink dosing device according to claim 16, wherein:

said plurality of shims comprises a plurality of elastic washers; and each of said plurality of elastic washers is disposed adjacent to a corresponding one of said plurality of screws.

18. The ink dosing device according to claim 17, wherein each of said plurality of dosing elements are connected to said base body by three screws of said plurality of screws and three elastic washers of said plurality of elastic washers.

19. The ink dosing device according to claim 18, wherein said three screws and said three elastic washers corresponding to one of said plurality of dosing elements are configured and disposed to permit alignment of said corresponding dosing element with the others of said plurality of dosing elements.

20. The ink dosing device according to claim 19, wherein:

said three screws and said three elastic washers corresponding to one of said plurality of dosing elements being configured and disposed to permit an adjustment of the distance between said base body and said corresponding dosing element and an adjustment of the inclination of said corresponding dosing element with respect to said base body;

each of said plurality of dosing elements comprises a first end and a second end disposed opposite to said first end;

said first end of each of said plurality of dosing elements to be disposed adjacent to an outer surface of an inking roller;

said plurality of screws and said plurality of elastic washers are disposed adjacent to said second end of each of said plurality of dosing elements;

said ink dosing device comprises an actuator arrangement;

said actuator arrangement being configured and disposed to adjust the distance between said first end of each of said plurality of dosing elements and an outer surface of an inking roller;

each of said plurality of dosing elements being substantially tongue-shaped; and said plurality of elastic washers comprises one of:

conical spring washers; and

Belleville spring washers.

* * * * *